US010490349B2

(12) United States Patent
Lee et al.

(10) Patent No.: US 10,490,349 B2
(45) Date of Patent: Nov. 26, 2019

(54) COIL COMPONENT AND METHOD FOR MANUFACTURING THE SAME

(71) Applicant: SAMSUNG ELECTRO-MECHANICS CO., LTD., Suwon-si, Gyeonggi-do (KR)

(72) Inventors: Sang Jong Lee, Suwon-si (KR); Su Bong Jang, Suwon-si (KR); Min Ki Jung, Suwon-si (KR); Han Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 103 days.

(21) Appl. No.: 15/472,010

(22) Filed: Mar. 28, 2017

(65) Prior Publication Data

US 2018/0012696 A1 Jan. 11, 2018

(30) Foreign Application Priority Data

Jul. 7, 2016 (KR) ..... 10-2016-0085973
Jul. 27, 2016 (KR) ..... 10-2016-0095697

(51) Int. Cl.
*H01F 5/00* (2006.01)
*H01F 41/04* (2006.01)
*H01F 17/00* (2006.01)

(52) U.S. Cl.
CPC ..... *H01F 41/043* (2013.01); *H01F 17/0013* (2013.01); *H01F 2017/002* (2013.01); *H01F 2017/0073* (2013.01)

(58) Field of Classification Search
USPC ..... 336/200, 232, 192, 83
See application file for complete search history.

(56) References Cited

U.S. PATENT DOCUMENTS

2003/0134612 A1* 7/2003 Nakayama ..... H01F 17/0013 455/307
2006/0158301 A1* 7/2006 Shinkai ..... H01F 17/0013 336/232
2009/0243777 A1* 10/2009 Toi ..... H01F 19/06 336/192
2014/0078643 A1* 3/2014 Odahara ..... H01F 17/0013 361/306.3
2014/0253277 A1* 9/2014 Takezawa ..... H01F 27/2804 336/200
2016/0049234 A1* 2/2016 Kawashima ..... H01F 17/0013 336/200

FOREIGN PATENT DOCUMENTS

JP 411097244 A * 9/1997
JP 09-298115 11/1997
JP 11-97244 A 4/1999
JP 5835252 B2 12/2015

* cited by examiner

*Primary Examiner* — Elvin G Enad
*Assistant Examiner* — Kazi S Hossain
(74) *Attorney, Agent, or Firm* — Morgan, Lewis & Bockius LLP

(57) ABSTRACT

A coil component includes a body including a plurality of first and second coil patterns, which are alternately disposed, and insulating layers disposed therebetween. The first coil patterns may be connected to the second coil patterns adjacent to the first coil patterns by vias, a plurality of coils including at least one each of the first and second coil patterns may be formed, and the plurality of coils may be connected in parallel to each other.

12 Claims, 8 Drawing Sheets

COMPARATIVE EXAMPLE

COMPARATIVE EXAMPLE

COMPARATIVE EXAMPLE

COMPARATIVE EXAMPLE

COIL COMPONENT AND METHOD FOR MANUFACTURING THE SAME

CROSS-REFERENCE TO RELATED APPLICATION(S)

This application claims the benefit of priority to Korean Patent Application Nos. 10-2016-0085973, filed on Jul. 7, 2016 and 10-2016-0095697, filed on Jul. 27, 2016 in the Korean Intellectual Property Office, the entire disclosure of which is incorporated herein by reference.

BACKGROUND

1. Technical Field

The present disclosure relates to a coil component and a method for manufacturing the coil component.

2. Description of Related Art

Smartphones recently have been using a signal having a wide frequency band. A coil component is often used as an impedance matching circuit in a radio frequency (RF) system for transmission/reception of a high frequency signal, and the use of the above-mentioned high frequency coil component continues to increase.

The coil component should be usable at a high frequency, for example 100 MHz or more, due to a self resonance frequency (SRF) of a high frequency band and low specific resistance based on the miniaturization thereof. In addition, in order to reduce loss within the frequency of a device, high quality factor Q characteristics are required.

Since current coil components implement a high quality factor Q, using materials having low specific resistance, by means of a photolithography method, the characteristics of the materials are very important. In the case in which such materials are used, however, in order to implement high quality factor Q characteristics, optimization of a shape and structure of a coil of the coil component are required.

SUMMARY

An aspect of the present disclosure may provide a coil component capable of simplifying a manufacturing process and preventing a bottleneck phenomenon of a current by reducing the number of vias.

According to an aspect of the present disclosure, a coil component may include a body including a plurality of first and second coil patterns, which are alternately disposed, and insulating layers disposed therebetween, wherein each of the first coil patterns is electrically connected to an adjacent one of the second coil patterns with one via, a plurality of coils including at least one each of the first and second coil patterns are formed, and the plurality of coils are connected in parallel to each other.

BRIEF DESCRIPTION OF DRAWINGS

The above and other aspects, features and other advantages of the present disclosure will be more clearly understood from the following detailed description when taken in conjunction with the accompanying drawings, in which.

DETAILED DESCRIPTION

Hereinafter, exemplary embodiments of the present disclosure will be described in detail, with reference to the accompanying drawings.

Figure 8A:
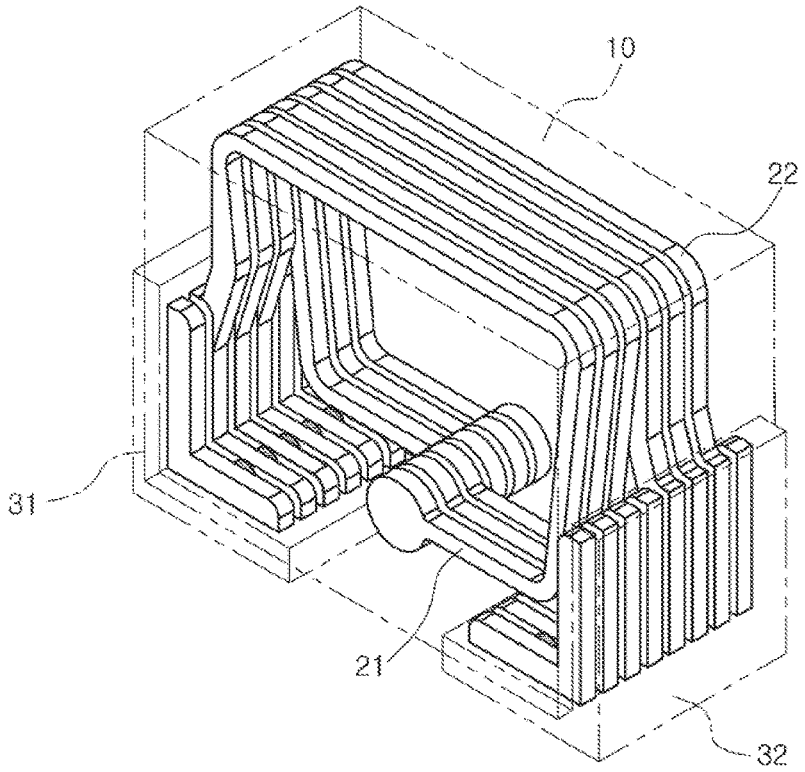
FIG. 8A schematically illustrates a perspective view of a coil component according to a comparative example in the present disclosure.
Figure 8B:
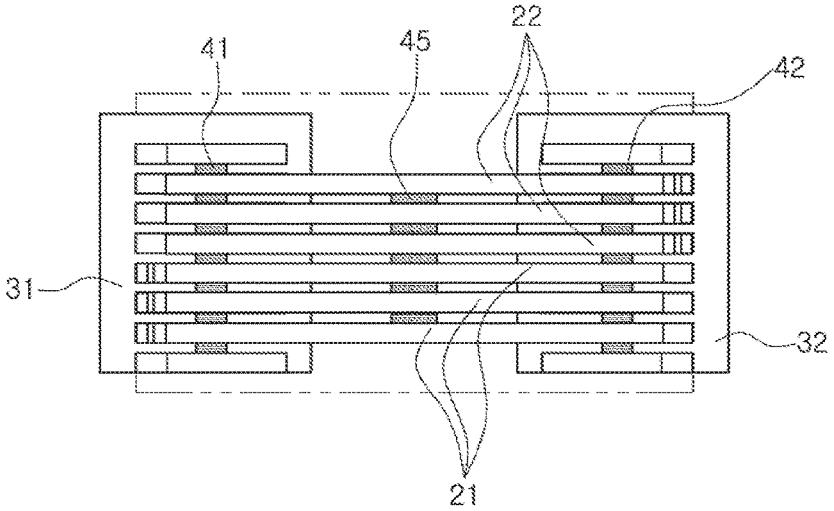
FIG. 8B illustrates a plan view of a coil of the coil component of FIG. 8A.

FIG. 8A schematically illustrates a perspective view of a coil component according to a comparative example in the present disclosure, and FIG. 8B illustrates a plan view of a coil of the coil component of FIG. 8A.

Referring to FIGS. 8A and 8B, a coil component according to a comparative example in the present disclosure includes a body 10 in which six insulating layers, on which first and second coil patterns 21 and 22 having different polarities are formed, are stacked, wherein three insulating layers, on which the first coil pattern 21 is formed, may be disposed to be adjacent to each other, three insulating layers on which the second coil pattern 22 is formed may be adjacent to each other, and the first coil pattern and the second coil pattern may be connected in parallel to each other by a via 45.

However, since the above-mentioned structure has three parallel circuits of the first coil pattern and three parallel circuits of the second coil pattern which are connected to each other by the vias formed in a single position, a bottleneck phenomenon, in which a flow of current concentrates on one via, may occur, which causes current density of the via to increase, thus increasing resistance loss of the coil component.

Figure 9A:
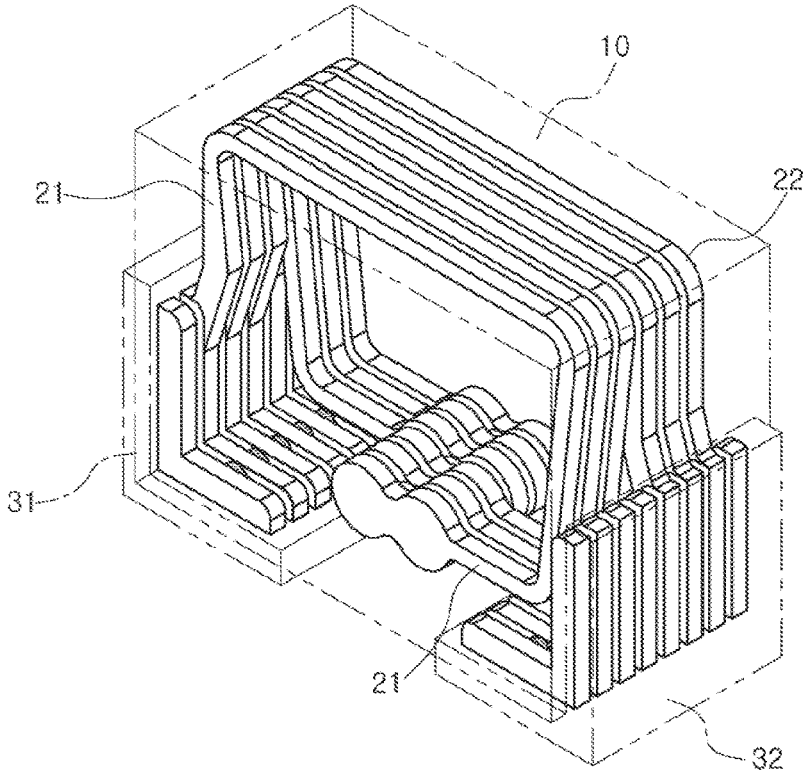
FIG. 9A schematically illustrates a perspective view of a coil component according to another comparative example in the present disclosure.
Figure 9B:
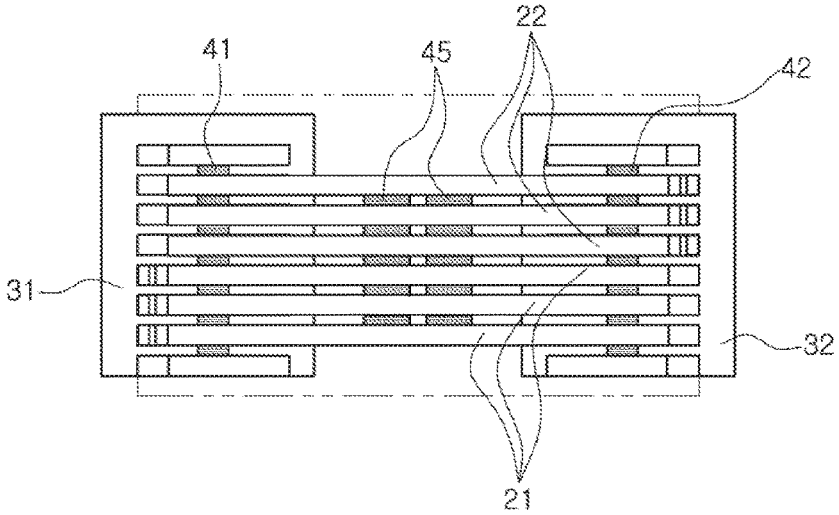
FIG. 9B illustrates a plan view of a coil of the coil component of FIG. 9A.

FIG. 9A schematically illustrates a perspective view of a coil component according to another comparative example in the present disclosure, and FIG. 9B illustrates a plan view of a coil of the coil component of FIG. 9A.

Referring to FIGS. 9A and 9B, the coil component according to another comparative example in the present disclosure may have three parallel circuits of the first coil pattern 21 and the three parallel circuits of the second coil pattern 22 which are connected to each other by vias 45 formed in two positions, unlike FIGS. 8A and 8B.

As compared to the comparative example of FIGS. 8A and 8B, since the above-mentioned structure of FIGS. 9A and 9B divides the density of current flowing in one via by two, the density of current flowing in one via may be lowered and the resistance loss of the coil component may be mitigated. However, as the number of vias is increased, a manufacturing process may become complicated, and it may be difficult to adjust an alignment of the vias, which may result in a defect in which the coil patterns are not properly connected. In addition, since an insulation distance between the coil patterns may be increased, unlike in the case of a design, a problem may occur in which inductance is decreased and a distribution of product characteristics is increased.

Hereinafter, a coil component according to an exemplary embodiment in the present disclosure will be described.

Figure 1:
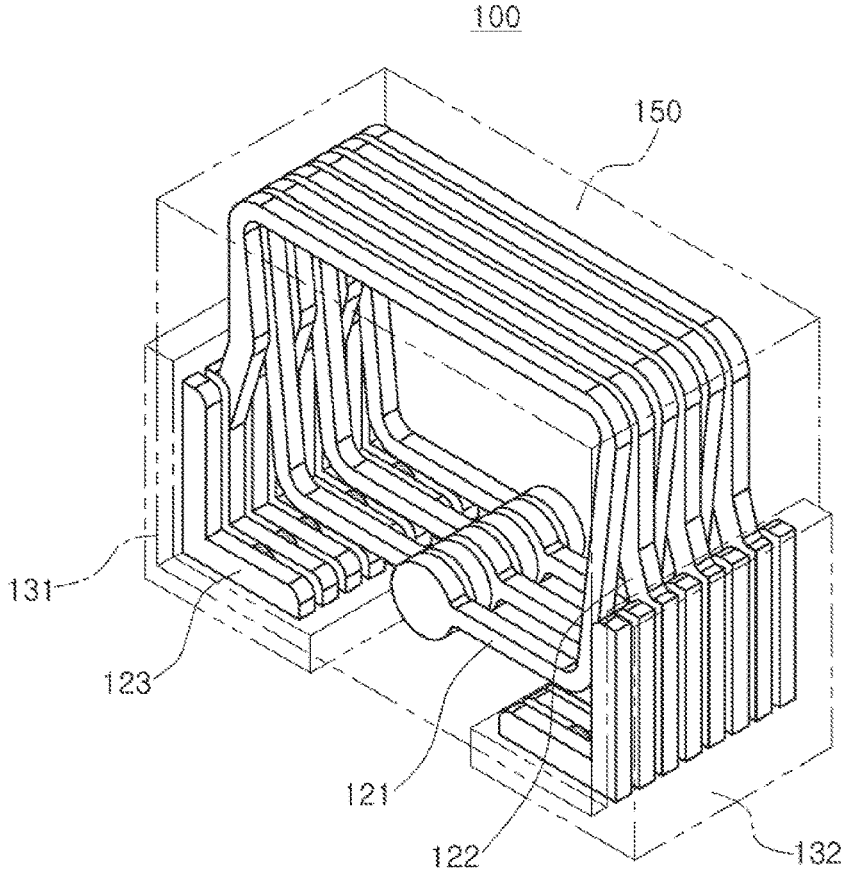
FIG. 1 schematically illustrates a perspective view of a coil component according to an exemplary embodiment in the present disclosure.
Figure 2:
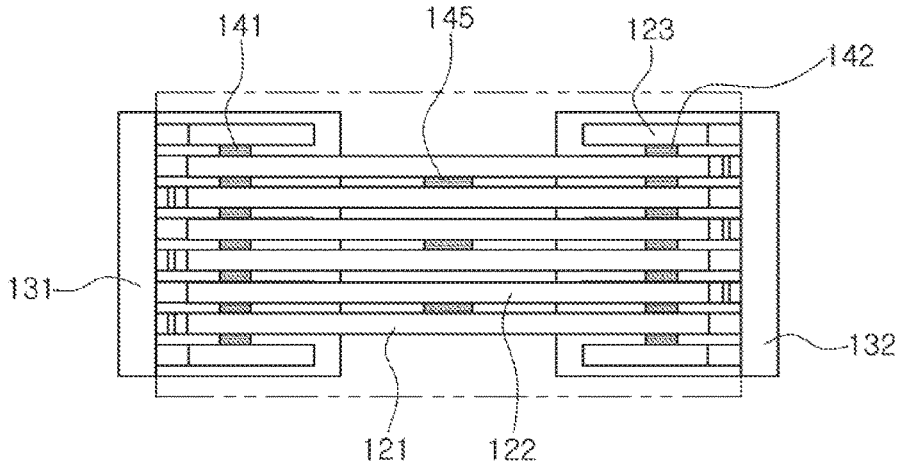
FIG. 2 illustrates a plan view of the coil of the coil component of FIG. 1.
Figure 3:
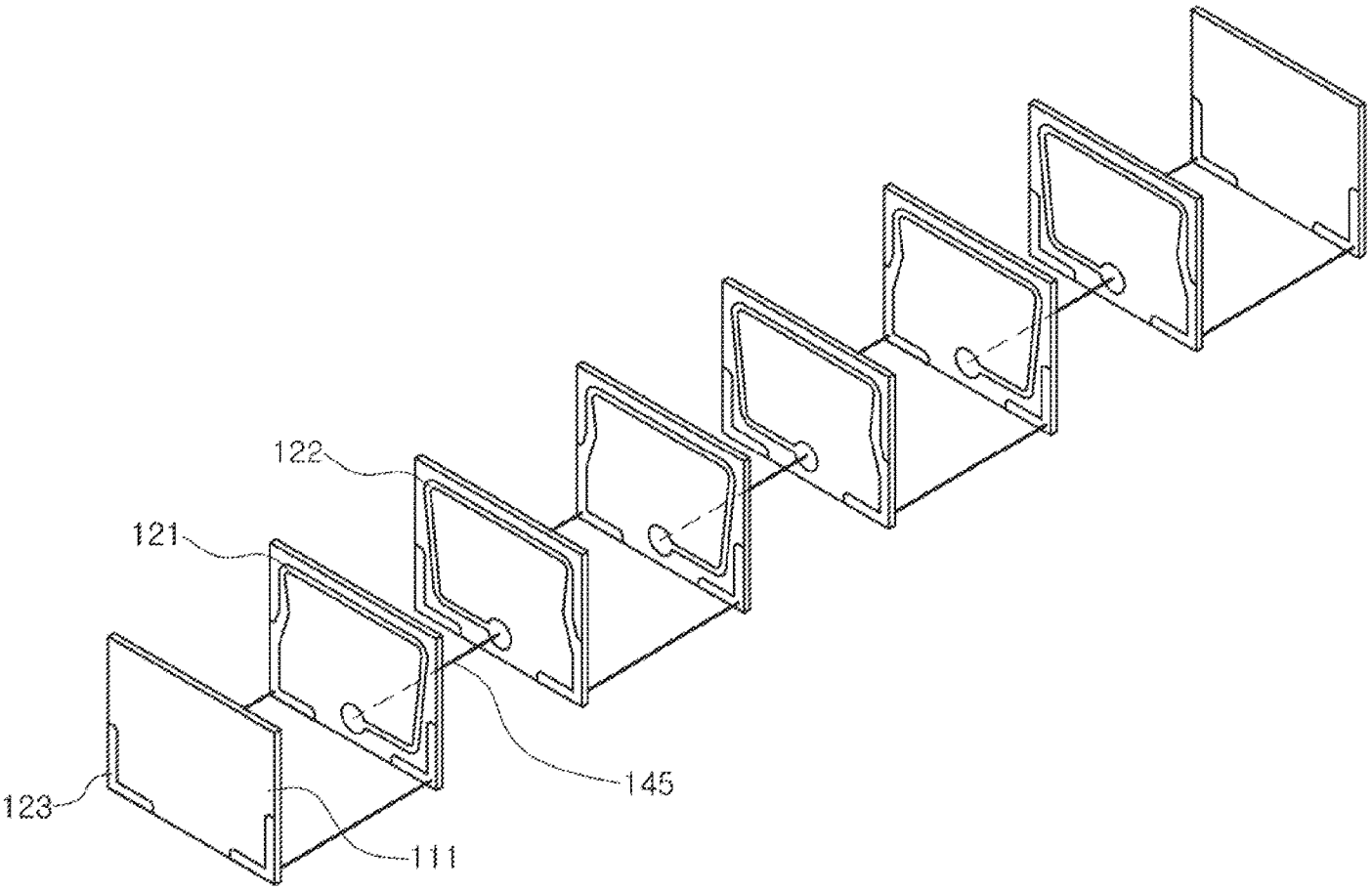
FIG. 3 schematically illustrates an exploded view of a body of the coil component according to an exemplary embodiment in the present disclosure.

FIG. 1 schematically illustrates a perspective view of a coil component including a coil according to an exemplary embodiment in the present disclosure, FIG. 2 illustrates a plan view of the coil of the coil component of FIG. 1, and FIG. 3 schematically illustrates an exploded view of a body of the coil component according to an exemplary embodiment in the present disclosure.

Referring to FIGS. 1 through 3, a coil component 100 according to an exemplary embodiment in the present disclosure may include a body 150 including a plurality of first and second coil patterns 121 and 122, which are alternately disposed, and insulating layers disposed therebetween, wherein the first coil pattern 121 may be connected to the second coil pattern 122, which is adjacent to the first coil pattern 121 by a via 145, a plurality of coils including at least a pair of the first and second coil patterns 121 and 122 may be formed, and the plurality of coils may be connected in parallel to each other.

The body 150 may be formed by stacking a plurality of insulating layers. The plurality of insulating layers forming the body 150 may be in a sintered state, and the boundaries between the adjacent insulating layers may be integrated with each other, so that it may be difficult to confirm the boundaries without the use of a scanning electron microscope (SEM).

The body 150 may have a hexahedral shape. The directions of sides of a hexahedron will be defined in order to clearly describe an exemplary embodiment in the present disclosure. L, W and T, shown in FIG. 1, refer to a length direction, a width direction, and a thickness direction, respectively.

The body 150 may be formed of a ferrite, and the ferrite may be, for example, a Mn-Zn-based ferrite, a Ni-Zn-based ferrite, a Ni-Zn-Cu-based ferrite, a Mn-Mg-based ferrite, a Ba-based ferrite, a Li-based ferrite, or the like, but the body 150 is not limited thereto.

The first and second coil patterns 121 and 122 may be formed by printing a conductive paste containing a conductive metal on the plurality of insulating layers 11 forming the body 150 at a predetermined thickness.

The first and second coil patterns 121 and 122 may have different polarities.

The conductive metal forming the first and second coil patterns is not particularly limited, as long as it has excellent electrical conductivity. For example, the conductive metal may be one or a combination of silver (Ag), palladium (Pd), aluminum (Al), nickel (Ni), titanium (Ti), gold (Au), copper (Cu), and platinum (Pt).

The via 145 may be formed at a predetermined position in each of the insulating layers on which the first and second coil patterns are formed, and the first and second coil patterns formed on each of the insulating layers may be electrically connected to each other by the via to form one coil.

The via 145 may be formed by forming a through-hole using a mechanical drill or a laser drill and then filling the through-hole with a conductive material by plating.

The via 145 may include a conductive material such as copper (Cu), aluminum (Al), silver (Ag), tin (Sn), gold (Au), nickel (Ni), lead (Pd), or an alloy thereof.

In this case, as the plurality of insulating layers 111, on which the first and second coil patterns are formed, are stacked in a width direction W of the body 150 or a length direction L thereof, the first and second coil patterns 121 and 122 may be disposed in a direction perpendicular to a board mounting surface of the body 150.

The first and second coil patterns 121 and 122 may include the first coil pattern 121, which is exposed to one surface of the body 150 in the length direction of the body 150, and the second coil pattern 122, which is exposed to the other surface of the body 150 in the length direction of the body 150.

A coil component according to the related art has a structure in which first coil patterns, which are connected in parallel to each other, and second coil patterns, which are connected in parallel to each other, are connected to each other by vias formed in one or two positions. Since the above-mentioned structure has the vias which are disposed in a line, a bottleneck phenomenon, in which a flow of current concentrates on the vias, which are disposed in a line, may occur, thereby increasing current density of the via and causing resistance loss in the coil component. In addition, since the vias are formed with a high concentration in one position, an insulation distance between the insulating layers may be varied when the body is formed.

The coil component according to an exemplary embodiment may have the first and second coil patterns 121 and 122 which are alternately disposed, the first coil patterns 121 may be connected to the second coil patterns 122, which are adjacent to the first coil patterns 121 by the vias 145, and a plurality of coils, including at least a pair of the first and second coil patterns, may be formed. The plurality of coils may be connected in parallel to each other, thereby preventing the bottleneck phenomenon of the current concentrated on the vias.

A via may electrically connect the first coil pattern 121 to one of the second coil patterns 122 adjacent to the first coil pattern 121, and the first coil pattern 121 may not be electrically connected to the other second coil pattern 122 adjacent to the first coil pattern 121.

Referring to FIG. 2, a plurality of first coil patterns 121 may be connected in parallel to each other, a plurality of second coil patterns 122 may be connected in parallel to each other, and the first coil patterns 121 and the second coil patterns 122 may be connected in series with each other. The first coil patterns and the second coil patterns, which are alternately disposed, may be electrically connected to each other through the vias to form one coil, and a plurality of coils may be connected in parallel to each other.

The number of vias 145 may be smaller than the sum of the numbers of first and second coil patterns 121 and 122. In the case of the body including the first and second coil patterns, if a total number of first and second coil patterns is n, the number of vias may be n/2.

Referring to FIGS. 1 through 3, the body may include three first coil patterns 121 and three second coil patterns 122, and the vias 145 may be formed between the first coil patterns and the second coil patterns. By the above-mentioned structure, only three vias may be disposed, and three coils may be connected in parallel to each other by the connection of the vias.

The first coil patterns 121 and the second coil patterns 122 may have three parallel circuits which are each connected by a separate via 145, and density of a current flowing in each of the vias may become lower, to significantly reduce resistance loss. In addition, unlike in the comparative example, since one coil pattern is connected to the coil pattern adjacent to one coil pattern, the process may be simplified and an influence on the insulation distance due to the vias may be reduced, thereby reducing a distribution of product characteristics.

The first and second coil patterns 121 and 122 may have a shape such as a polygonal shape, circular shape, oval shape, track shape, or the like.

Figure 4:
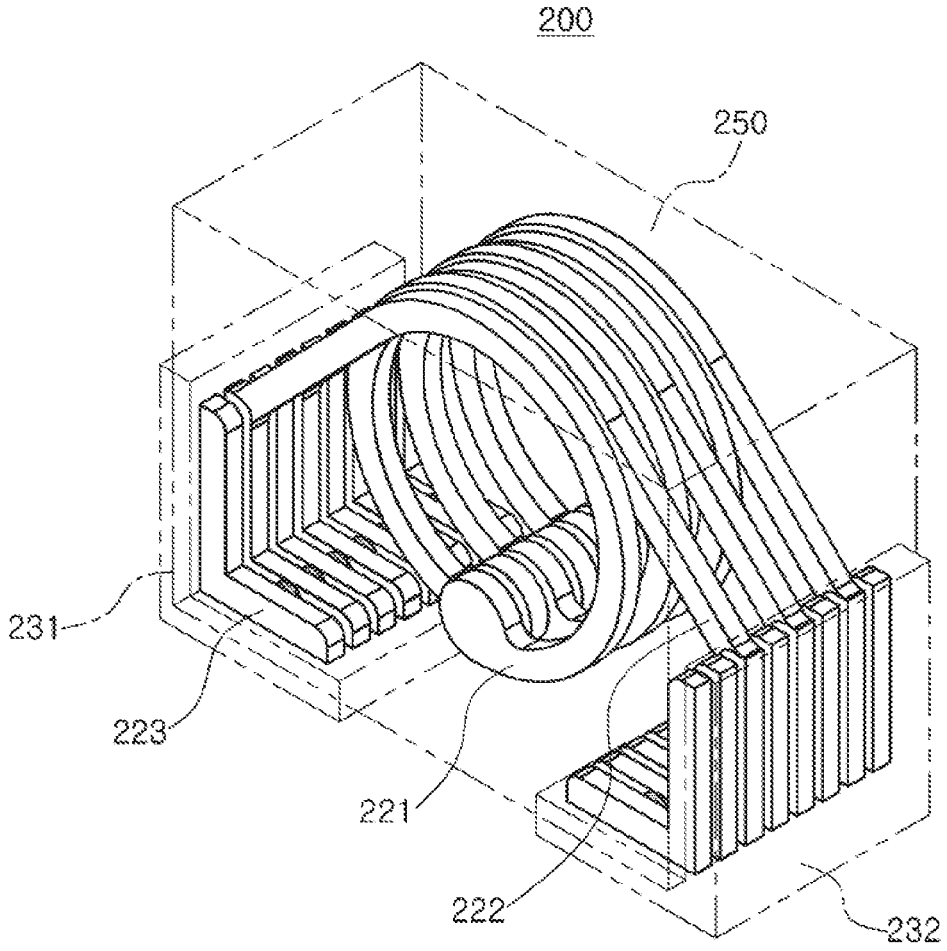
FIG. 4 schematically illustrates a perspective view of a coil component according to another exemplary embodiment in the present disclosure.

FIG. 4 schematically illustrates a perspective view of a coil component according to another exemplary embodiment in the present disclosure.

FIG. 4 illustrates the coil component in which the first and second coil patterns have a round shape, unlike the coil component of FIG. 1.

In a case in which a cross-section shape of the first and second coil patterns is a polygonal shape, since corner portions of the cross-section shape have higher current density than other linear portions, resistance loss of the coil component may be increased and Q characteristics may be degraded.

Different than this, in the case of the coil component according to the present exemplary embodiment, since the first and second coil patterns 121 and 122 have the round shape, better Q characteristics may result.

Figure 5:
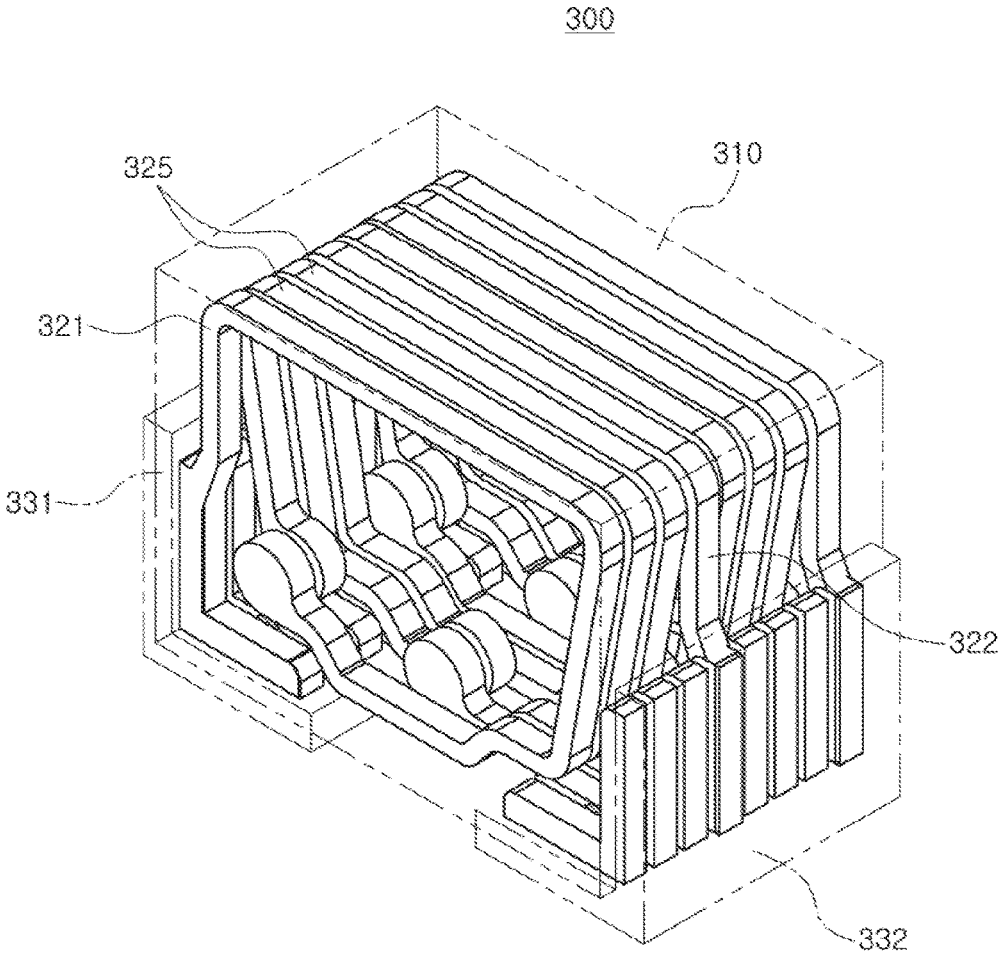
FIG. 5 schematically illustrates a perspective view of a coil component according to another exemplary embodiment in the present disclosure.
Figure 6:
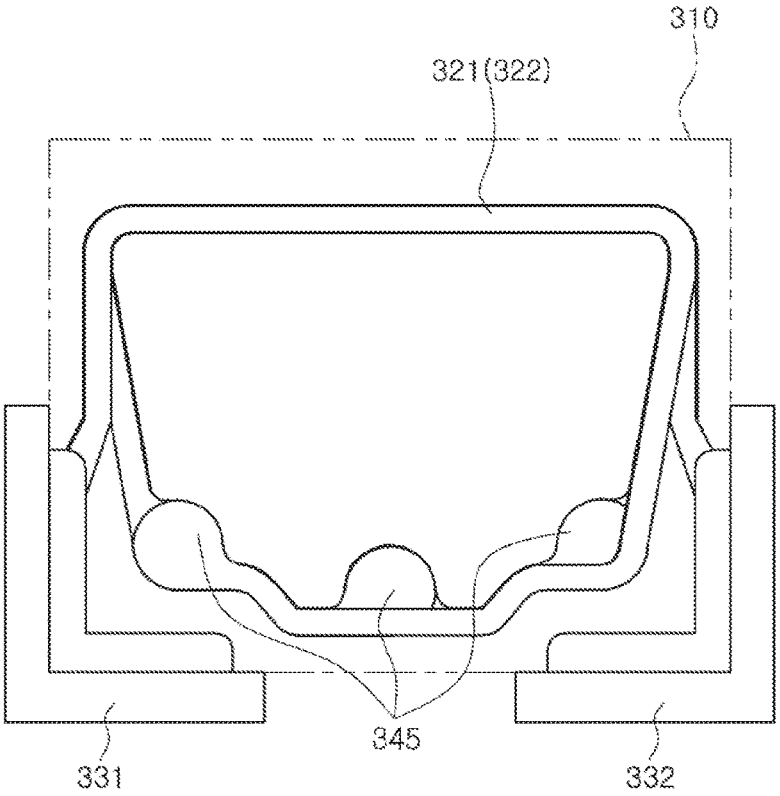
FIG. 6 illustrates a front view of a coil of the coil component of FIG. 5.
Figure 7:
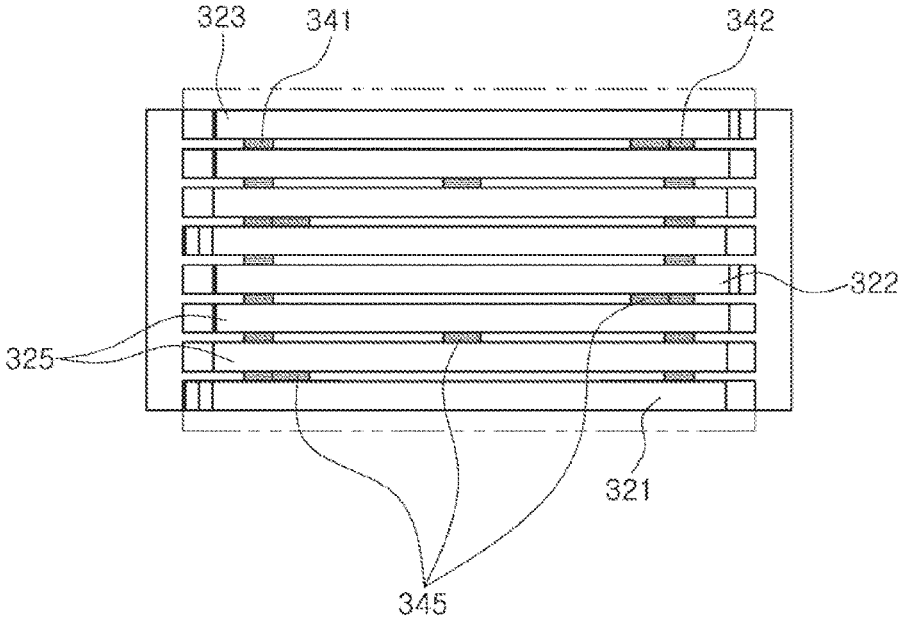
FIG. 7 illustrates a plan view of the coil of the coil component of FIG. 5.

FIG. 5 schematically illustrates a perspective view of a coil component according to another exemplary embodiment in the present disclosure, FIG. 6 illustrates a front view of a coil of the coil component of FIG. 5, and FIG. 7 illustrates a plan view of the coil of the coil component of FIG. 5.

A description of the same components as those illustrated in FIGS. 1 through 4 will be omitted.

Referring to FIGS. 5 through 7, a coil component according to an exemplary embodiment in the present disclosure may include first and second coil patterns 321 and 322, and via connection patterns 325 disposed between the first coil patterns and the second coil patterns, unlike in the exemplary embodiment of FIG. 1.

The via connection patterns 325 may be formed of a plurality of layers.

The via connection patterns 325 may be connected to the first and second coil patterns 321 and 322 by vias 345.

In the case in which the coil component further includes the via connection patterns, the number of turns of the coil may be increased to improve characteristics of the coil component.

Referring to FIGS. 5 through 7, the coil body may have four coil patterns having different shapes, and may include two first coil patterns 321, two second coil patterns 322, and two via connection patterns 325 disposed between one first coil pattern and one second coil pattern, and the vias 345 may be formed between the first coil patterns 321 and the via connection patterns 325, and between the second coil patterns 322 and the via connection patterns 325. In the above-mentioned structure, three vias may be formed in one coil, a total of six vias may be disposed, and two coils may be connected in parallel to each other by connecting the vias.

Meanwhile, although FIGS. 5 through 7 illustrate the coil component having the four coil patterns, the number of coil patterns is not necessarily limited thereto, but may be applied to all coil components having other stack structures and including parallel circuits.

The first coil pattern 121 may have a first lead portion (not shown) which is exposed to a surface perpendicular to a stack surface of the body 150, and the second coil pattern 122 may have a second lead portion (not shown) which is exposed to the surface perpendicular to the stack surface of the body 150.

For example, the first and second lead portions may be exposed to one end surface of the body 150 and the other end surface of the body 150 in the length direction L of the body 150, perpendicular to the stack surface of the stacked insulating layers.

In addition, the first and second lead portions may also be exposed to a bottom surface, which is a board mounting surface of the body 150. That is, the first and second lead portions may have an L shape in an end surface of the body 150 in a length-thickness direction of the body 150.

According to an exemplary embodiment, the body 150 may further include a dummy lead portion 123 which is disposed on the plurality of insulating layers and exposed to the outside.

The dummy lead portion 123 may be included in the body 150 by forming a pattern on the plurality of insulating layers in the same shape as the first lead portion and the second lead portion.

The dummy lead portion 123 maybe connected to the first and second coil patterns 121 and 122 through first and second dummy vias 141 and 142, and the first coil pattern and the second coil pattern may be connected in parallel to each other.

That is, the body 150 according to an exemplary embodiment may be implemented by stacking the plurality of insulating layers on which the first and second coil patterns 121 and 122 are formed, and the plurality of insulating layers on which the dummy lead portion 123 is formed, to be adjacent to each other.

By stacking the plurality of insulating layers on which the dummy lead portion 123 is formed to be adjacent to the plurality of insulating layers on which the first and second coil patterns 121 and 122 are formed, since a large number of metal bonds with the external electrodes 131 and 132 disposed on the end surface and the bottom surface of the body 150 in the length direction of the body 150 may occur, adhesion between the first and second coil patterns and the external electrodes, and adhesion between an electronic component and a printed circuit board, may be improved.

The coil component according to an exemplary embodiment in the present disclosure may include a first external electrode 131 disposed on one end surface of the body 150 and a bottom surface of the body 150 in the length direction of the body 150 and connected to the first lead portion, and a second external electrode 132 disposed on the other end surface of the body 150 and the bottom surface of the body 150 in the length direction of the body 150 and connected to the second lead portion.

The first external electrode 131 and the second external electrode 132 may be formed on the bottom surface of the body 150 and on surfaces perpendicular to the stack surface thereof, and particularly on one end surface of the body 150 in the length direction of the body 150 and the other end surface of the body 150 opposing the one end surface of the body 150.

A material of the first external electrode 131 and the second external electrode 132 is not particularly limited, as long as it is a plateable metal. For example, the material may be one of nickel (Ni) and tin (Sn) or a combination thereof.

Hereinafter, a method for manufacturing a coil component according to an exemplary embodiment in the present disclosure will be described.

Figure 10:
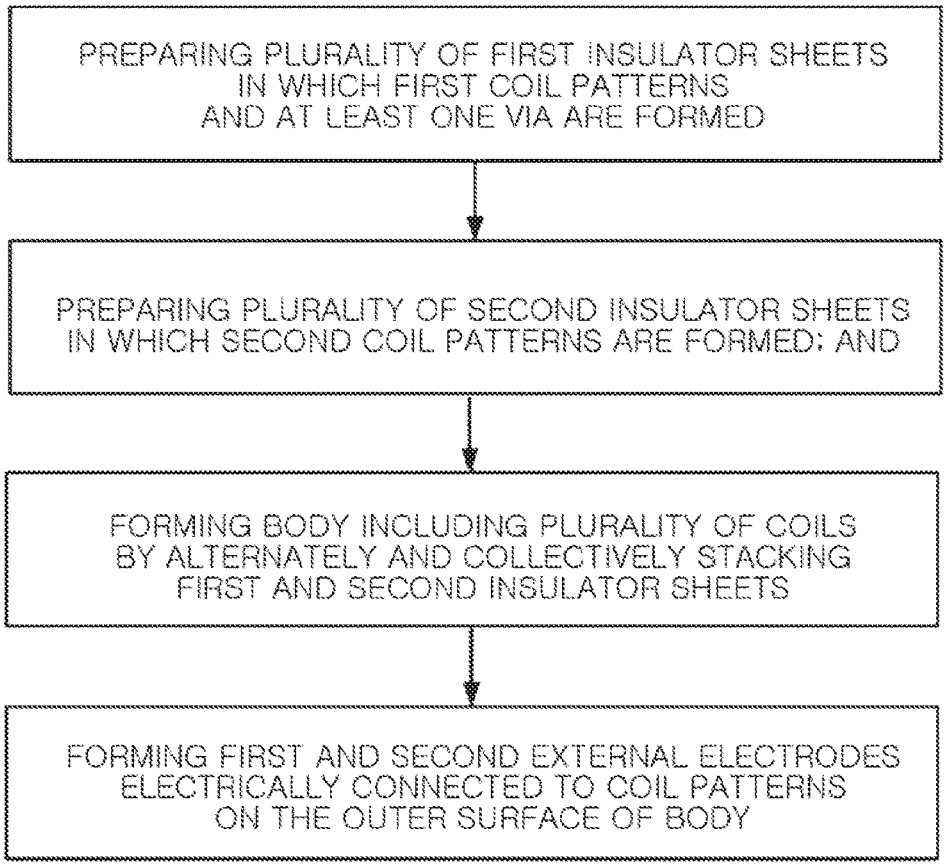
FIG. 10 is a flow chart illustrating a method for manufacturing a coil component according to an exemplary embodiment in the present disclosure.

FIG. 10 is a flow chart illustrating a method for manufacturing a coil component according to an exemplary embodiment in the present disclosure.

Referring to FIG. 10, a method for manufacturing a coil component according to an exemplary embodiment in the present disclosure may include an operation of preparing a plurality of insulator sheets in which first coil patterns and one via are formed, an operation of preparing a plurality of second insulator sheets in which second coil patterns are formed, and an operation of forming a body including a plurality of coils by alternately and collectively stacking the first and second insulator sheets, wherein the first coil patterns may be connected to the second coil patterns, which are adjacent to the first coil patterns, by vias to form the plurality of coils including at least a pair of the first and second coil patterns, and the plurality of coils may be connected in parallel to each other.

First, a plurality of insulator sheets may be prepared.

A magnetic material used to manufacture the insulator sheet is not particularly limited, and, for example, a well-known ferrite powder may be used such as an Mn-Zn-based ferrite powder, an Ni-Zn-based ferrite powder, an Ni-Zn-Cu-based ferrite powder, an Mn-Mg-based ferrite powder, a Ba-based ferrite powder, an Li-based ferrite powder, or the like.

The plurality of insulator sheets may be prepared by applying and drying a slurry formed by mixing the magnetic material and an organic material with each other on a carrier film.

Next, a plurality of first insulator sheets in which first coil patterns and a via are formed may be prepared, and a plurality of second insulator sheets in which a second coil pattern is formed may be prepared.

The first and second coil patterns may be formed in a thickness direction of the insulator sheet, and the via may be formed by forming a through-hole, using a mechanical drill or a laser drill, and then filling the through-hole with a conductive material by plating.

The first and second coil patterns may be formed by applying a conductive paste containing a conductive metal on the insulator sheet by a printing method, or the like.

The conductive paste may be printed by a screen printing method, a gravure printing method, or the like, but is not limited thereto.

The conductive metal is not particularly limited, as long as it is a metal having excellent electrical conductivity. For example, the conductive metal may be one or a combination of silver (Ag), palladium (Pd), aluminum (Al), nickel (Ni), titanium (Ti), gold (Au), copper (Cu), and platinum (Pt).

The via may include a conductive material such as copper (Cu), aluminum (Al), silver (Ag), tin (Sn), gold (Au), nickel (Ni), lead (Pd), or an alloy thereof.

The first and second coil patterns may form the coil in an operation of forming a body by alternately and collectively stacking the first and second insulator sheets as described below, and may include a first lead portion and a second lead portion.

Next, a body including a plurality of coils may be formed by alternately and collectively stacking the first and second insulator sheets.

By stacking the first and second insulator sheets, the body, including the coil, of which the first lead portion and the second lead portion are exposed to a bottom surface and surfaces are perpendicular to a stack surface, may be formed.

The via may be formed between the first coil pattern and the second coil pattern, and the first and second coil patterns formed on each of the insulating layers may be electrically connected to each other by the via to form one coil.

The first lead portion and the second lead portion of the first and second coil patterns forming one coil may be exposed to the bottom surface of the body and the surfaces perpendicular to the stack surface thereof.

Meanwhile, the first and second coil patterns may be formed in a direction perpendicular to a board mounting surface of the body.

The first external electrode and the second external electrode, which are each connected to the first lead portion and the second lead portion of the first and second coil patterns, maybe formed on the bottom surface of the body and the surfaces perpendicular to the stack surface thereof.

The first and second external electrodes may be formed of a conductive paste containing a metal having excellent electric conductivity. For example, the conductive paste may contain one of nickel (Ni) and tin (Sn), or an alloy thereof.

The same features as those of the above-mentioned coil component according to an exemplary embodiment in the present disclosure will be omitted.

As set forth above, according to the exemplary embodiments in the present disclosure, the manufacturing process may be simplified and the bottleneck phenomenon of the current may be prevented.

While exemplary embodiments have been shown and described above, it will be apparent to those skilled in the art that modifications and variations could be made without departing from the scope of the present invention, as defined by the appended claims.

What is claimed is:

1. A coil component comprising:

a body including a plurality of first and second coil patterns which are alternately disposed, such that a first coil pattern is disposed between two second coil patterns and a second coil pattern is disposed between two first coil patterns, and insulating layers disposed therebetween, wherein each of the first coil patterns has a first end connected to a first end of an adjacent one of the second coil patterns with a respective via, a plurality of coils each includes at least one of the first and at least one of the second coil patterns, and the plurality of coils are electrically connected in parallel to each other by a first connection via extending through, and connecting to each other, a second end of each first coil pattern opposite to the first end of each first coil pattern, and by a second connection via extending through, and connecting to each other, a second end of each second coil pattern opposite to the first end of each second coil pattern.

2. The coil component of claim 1, wherein the plurality of first coil patterns are electrically connected in parallel to each other.

3. The coil component of claim 1, wherein the plurality of second coil patterns are electrically connected in parallel to each other.

4. The coil component of claim 1, wherein each respective via electrically connects a corresponding one of the first coil patterns to one of the second coil patterns adjacent to the corresponding one first coil pattern, and the corresponding one first coil pattern is not electrically connected to the other of the second coil patterns adjacent to the corresponding one first coil pattern by any via.

5. The coil component of claim 1, wherein each of the first coil patterns is electrically connected in series with the adjacent one of the second coil patterns.

6. The coil component of claim 1, wherein the plurality of first and second coil patterns have a polygonal shape, a circular shape, an oval shape, or a track shape.

7. The coil component of claim 1, wherein the plurality of first and second coil patterns have a round shape.

8. The coil component of claim 1, wherein the number of respective vias is smaller than a sum of the numbers of the first and second coil patterns.

9. The coil component of claim 1, wherein the number of respective vias is half the sum of the numbers of the first and second coil patterns.

10. The coil component of claim 1, wherein the body further includes a plurality of via connection patterns, and each via connection pattern is disposed between a respective first coil pattern and the adjacent one second coil pattern connected by the respective via to the respective first coil pattern.

11. The coil component of claim 10, wherein each via connection pattern is connected in series to the respective first coil pattern and the adjacent one second coil pattern by vias.

12. The coil component of claim 1, wherein each first coil pattern is exposed to a first end surface and a mounting surface of the body, and each second coil pattern is exposed to a second end surface, opposing the first end surface, and the mounting surface of the body.

* * * * *